United States Patent [19]

Yuge et al.

[11] Patent Number: 5,071,031

[45] Date of Patent: Dec. 10, 1991

[54] AUTOMATIC CASH TRANSACTION APPARATUS UTILIZING SUCCESSIVE CASH DISPENSING OPERATIONS

[75] Inventors: Akio Yuge, Yokohama; Shouichi Tobari, Tokyo, both of Japan

[73] Assignee: Kabushiki Kaisha Toshiba, Kawasaki, Japan

[21] Appl. No.: 521,557

[22] Filed: May 10, 1990

[30] Foreign Application Priority Data

May 22, 1989 [JP] Japan ..... 1-126765

[51] Int. Cl.[5] ..... G07F 9/02

[52] U.S. Cl. ..... 221/3; 221/9; 235/379

[58] Field of Search ..... 221/2, 3, 7, 8, 9, 13; 235/379; 902/13, 14, 17; 209/534

[56] References Cited

U.S. PATENT DOCUMENTS 4,428,501 1/1984 Osako ..... 221/13

4,450,978 5/1991 Graef et al. ..... 221/13

FOREIGN PATENT DOCUMENTS 62-6278 2/1987 Japan .

*Primary Examiner*—Robert P. Olszewski

*Assistant Examiner*—Dean A. Reichard

*Attorney, Agent, or Firm*—Cushman, Darby & Cushman

[57] ABSTRACT

An automatic cash transaction apparatus which dispenses a predetermined maximum amount of cash in each dipensing operation. When it is desired to dispense more than the maximum amount of cash, it carries out multiple dispensing operations. Means are provided for indicating to a user that further cash dispensing operations are to be carried out. This indication occurs no later than during the first such dispensing operation. This indication is provided by a so called "preinforming means" that, in a preferred embodiment, generates a synthetic sound to inform the execution of a next cash dispensing operation when a current cash dispensing operation is completed if the successive cash dispensing operations are carried out.

12 Claims, 3 Drawing Sheets

AUTOMATIC CASH TRANSACTION APPARATUS UTILIZING SUCCESSIVE CASH DISPENSING OPERATIONS

BACKGROUND OF THE INVENTION

1. Field of the Invention

The present invention relates, in general, to automatic cash transaction apparatus. In particular, the invention relates to an automatic cash depositing/dispensing apparatus which dispenses a requested amount of cash by carrying out successive dispensing operations whenever a requested amount of cash exceeds the amount of cash that ca be dispensed in a single dispensing operation.

2. Description of the Related Art

In recent years, banking practice has changed considerably. There has been proliferation of automatic depositing/dispensing apparatus known as automatic teller machines (ATM) and automatic dispensing apparatus known as cash dispensers (CD). ATMs and CDs may dispense cash upon verification of a user's memorized code (also known as a "password" or "personal identification number (PIN).

In particular types of ATMs or CDs, an amount of cash which can be dispensed during a single dispensing operation is limited at least in part by the capacity of a cash receiving/dispensing port of the apparatus. If a customer wants to dispense excess cash (more cash than can be dispensed during a single dispensing operation) he must cause the ATM or CD to carry out more than one dispensing operation. Oftentimes this requires going back to the very beginning of a cycle of machine operation (for example, re-inputting password etc.). This is particularly troublesome with regard to the use of cash receiving/dispensing apparatus used for cash management in a bank, wherein it is frequently requested to dispense an excess amount of cash at one time.

To overcome this problem, it has been proposed to a plurality of cash dispensing operations can be automatically carried out by an ATM or CD to dispense excess cash by causing more than one dispensing operation to occur in response to one manual operation by the customer when an excess amount of cash is requested. However, there is a danger in operating an ATM or CD in this manner. It may occur that the user misconceives the completion of dispensing operation. After a first dispensing operation, the customer may think that the ATM or CD has completely finished its cycle of operation. Yet, it may be performing one or more additional dispensing operations, i.e. the ATM or CD is continuing to function. A customer may actually walk away from a machine that is still dispensing money.

SUMMARY OF THE INVENTION

Accordingly, it is an object of the present invention to provide a new arrangement whereby a user can safely dispense a excess amount of cash from an ATM or CD.

More specifically, it is an object of the present invention to provide an arrangement whereby a user will not misconceive that a cash transaction has been completed when actually two or more dispensing operations are being carried out.

To accomplish these objects, the invention provides an automatic cash transaction apparatus having a novel arrangement which can more safely carry out automatic cash transactions with a customer. The apparatus includes an input section which the customer can use to input a requested amount of cash to be dispensed by the apparatus. The apparatus further includes a cash dispensing section. The cash dispensing section can carry out either a single cash dispensing operation (if the amount of cash requested by the customer is less than the maximum amount of cash that can dispensed by a single dispensing operation) or multiple cash dispensing operations (if the amount of cash requested by the customer is greater than the maximum amount of cash that can be dispensed by a single dispensing operation). A preinforming section provides an indication to the customer that the apparatus will carry out a further cash dispensing operation after the completion of a current cash dispensing operation in those situations where more than one cash dispensing operation will be carried out. This indication my be made by some visible indicator or by providing a sound that will draw the customer's attention.

The automatic cash transaction apparatus may include a display section for indicating when cash dispensing operations are completed.

The invention is also directed to a method for cash dispensing using an automatic cash transaction apparatus. The method includes the steps of:

inputting by a user a requested amount of cash;

determining whether a requested amount of cash exceeds a predetermined amount of cash that can be dispensed during a single dispensing operation of cash dispenser;

causing the cash dispensing means to a) perform a single cash dispensing operation when the requested amount of cash not exceed the maximum amount, and a) perform successive cash dispensing operations when the requested amount of cash exceeds the maximum amount; and inform a user that a successive cash dispensing operation will occur when a current cash dispensing operation is completed if a successive cash dispensing operation will take place.

BRIEF DESCRIPTION OF THE DRAWINGS

These and other objects and advantages of this invention will become more apparent from the following detailed description of the presently preferred embodiment- of invention, taken in conjunction with the accompanying drawings of which.

DESCRIPTION OF THE PRESENTLY PREFERRED EMBODIMENT

A preferred embodiment of the present invention will now be described with reference to the accompanying drawings. In this embodiment, the present invention is incorporated into a cash receiving/dispensing apparatus used for cash management in a bank.

Figure 1:
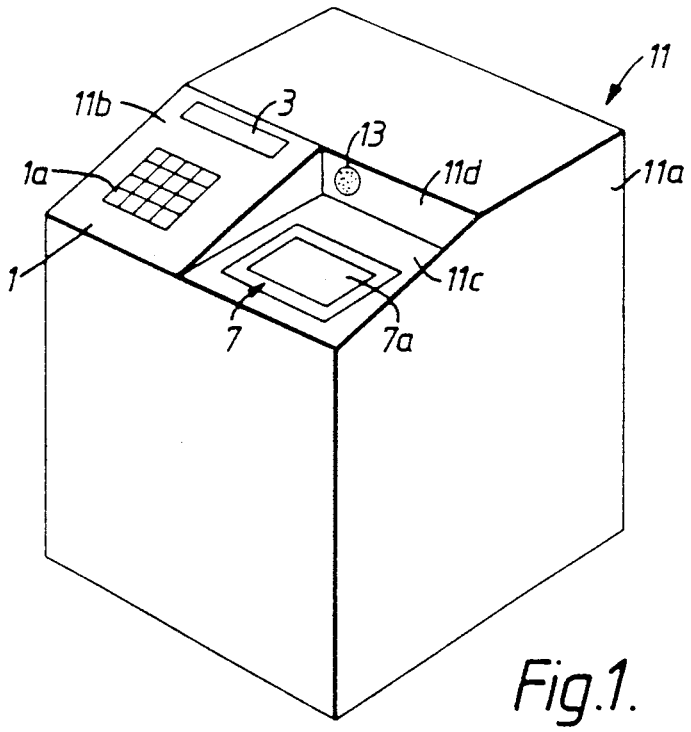
FIG. 1 is a perspective view of an automatic bill (bank note) transaction apparatus according to one embodiment of the present invention.
Figure 2:
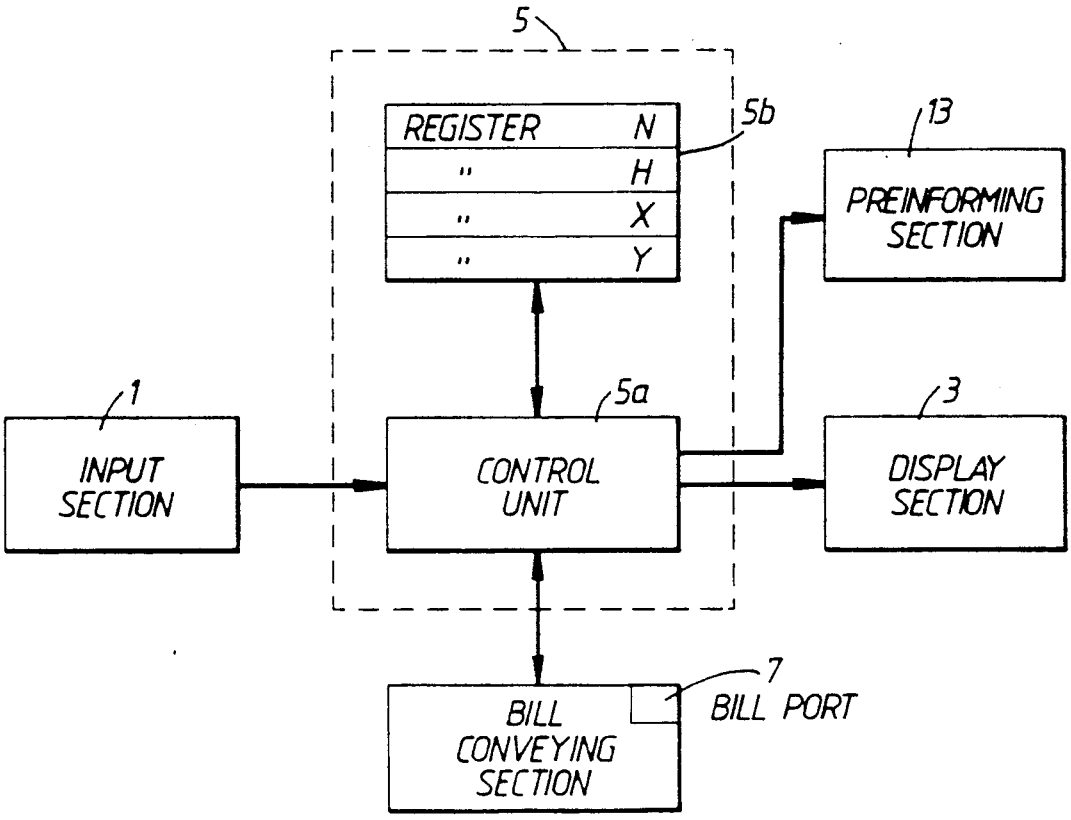
FIG. 2 is a block diagram of the automatic bill transaction apparatus shown in FIG. 1.

In FIGS. 1 and 2, a cash receiving/dispensing apparatus 11 includes a main body 11*a*. An input section 1 is arranged in a slant panel portion 1*b* of the upper surface of main body 11*a*. Input section 1 includes a key-board (a ten-key arrangement) 1*a* through which a user can input a desired command, e.g., receiving/dispensing operation, amount of cash dispensed, etc. A display section, i.e., CRT display unit, 3 also is arranged in slant panel portion 11*b* to display transaction information during the operation of apparatus 11. A bill receiving/dispensing port (bill port) 7 is provided in a flat panel portion 11*c* of the upper surface of main body 11*a*, and an informing section 13 is provided in a vertical panel portion 11*d* adjoining to flat panel portion 11*c*, as shown in FIG. 1. A transparent lid 7*a* is slidably arranged at bill port 7.

Preinforming section 13 includes preferably either a lamp or the combination of speaker and tone generator to inform the user of successive cash dispensing operations. Preinforming section 13 informs the user that a "next" dispensing operation will occur after the current dispensing operation has been completed. This "preinforming" occurs preferably while transparent lid 7*a* opens, or preferably when a bill is taken by the customer from bill port 7. A next dispensing operation may also be indicated by display section 3.

Figure 3:
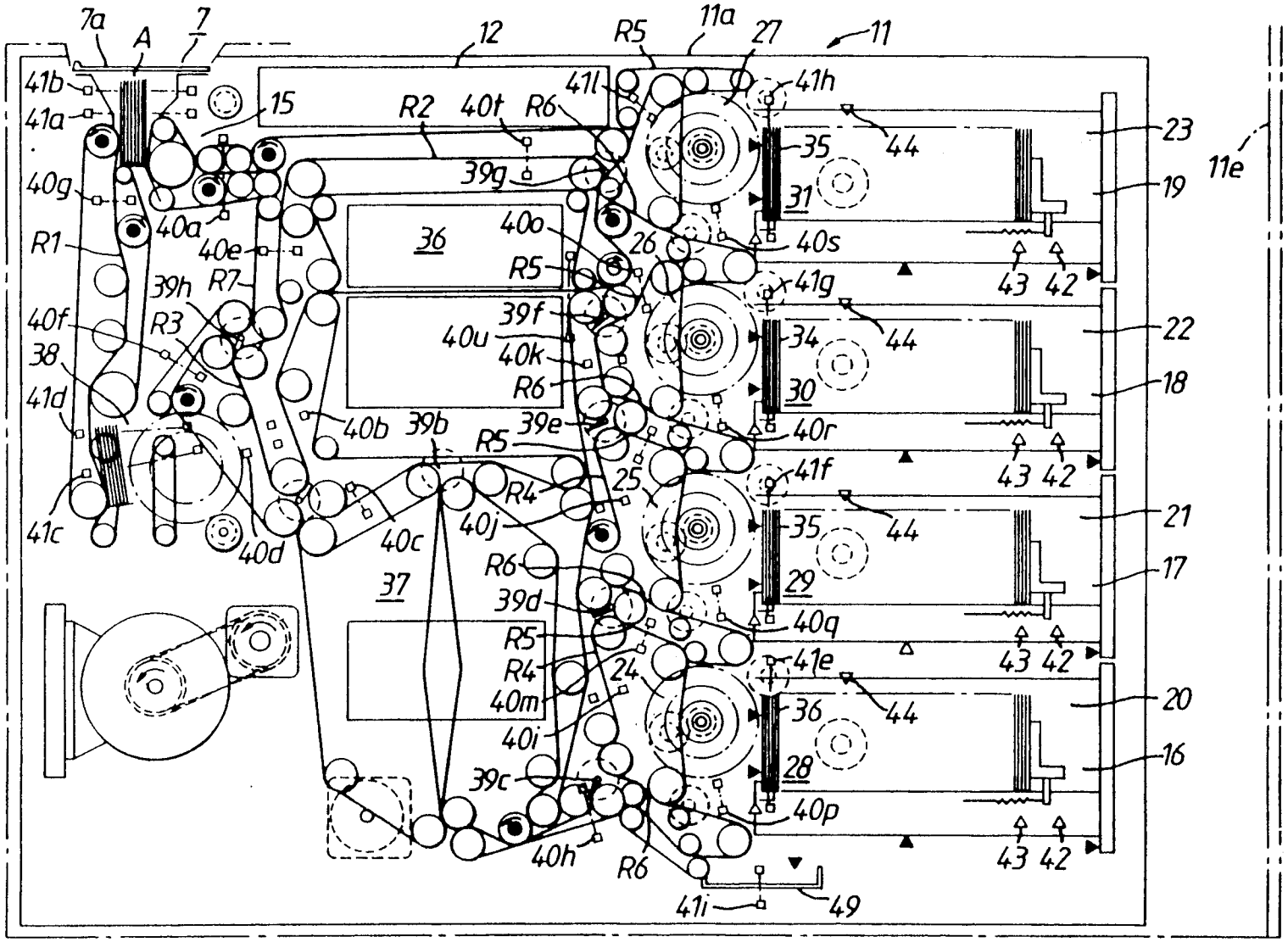
FIG. 3 is a side view of a bill conveying section of the automatic bill transaction apparatus shown in FIG. 1.

Main body 11*a* comprises a bill conveying section 9 including a bill receiving/dispensing mechanism 12, shown in FIG. 3, to convey stored bills from bill storage sections 20, 21, 22 and 23, shown in FIG. 3, to bill port 7. Main body 11*a* also comprises a control section 5 for controlling operations of the above-described display, conveying and preinforming sections 3, 9 and 13 in accordance with command entered via input section 1. Control section 5 comprises a control unit 5*a* including a microcomputer, and a plurality of registers H, N, X and Y which store data from control unit 5*a*.

FIG. 3 shows bill conveying section 9. Detailed construction and operation of bill conveying section 9 are disclosed in the U.S. Pat. No. 4,602,332, which is incorporated herein by reference, and which issued to the same assignee. Therefore, the disclosure of bill conveying section 9 will not be repeated herein. Bill receiving/dispensing mechanism 12 is housed in a main body 11*a*. A bill receiving/dispensing unit 15 is disposed in the upper portion of the front side (operator side) of main body 11*a* so as to oppose bill port 7. First, second, third and fourth cassette storage sections 16, 17, 18 and 19 are vertically defined from the bottom to the top of the rear side (counter-operator side) of main body 11*a*. Each of the first to fourth cassette storage section 16 to 19 is provided with corresponding bill cassettes 20, 21, 22 and 23. The first bill cassette 20 in first cassette storage section (improper bill storage section) 16 stores bills of a first denomination, e.g., $50, which are unfit for dispensation and rejected bills. The second bill cassette 21 in second cassette storage section 17 stores a second denomination, e.g., $10. The third bill cassette 22 in third cassette storage section 18 stores a third denomination, e.g., $100, and the fourth bill cassette 23 in fourth cassette storage section (recovery/loading section) 19 also stores recovery end loading bills. Each of the first to fourth bill cassettes 20 to 23 can be pulled out from main body 11*a* by opening a rear door 11*e* disposed at the rear side of main body 11*a* of cash receiving/ dispensing apparatus 11.

First, second, third and fourth bill stacking dispensing units 24, 25, 26 end 27 are disposed opposite to the outlet port of each corresponding cassette storage section 16, 17, 18, 19. Separator mechanisms 28, 29, 30 and 31 are respectively disposed in cassette storage sections 16, 17, 18 and 19 so as to adjoin corresponding bill stacking/dispensing units 24, 25, 26 and 27. Each of the first to fourth bill stacking/dispensing units 24 to 27 distinguishes the present transaction from the previous transaction. Thus, temporary storage sections 32, 33, 34 and 35 are formed between the mechanism 28 and unit 24, between the mechanism 29 and unit 25, between the mechanism 30 and unit 26, and between the mechanism 31 and unit 27, respectively.

A discrimination section 36 is disposed at a substantially central portion in main body 11*a* to perform a true/forged bill discrimination function, a denomination discrimination function, a wornout bill discrimination function. Discrimination section 36 also performs an improper transfer, e.g., overlapped bills, a reversed surface bill, a skewed bill, etc., discrimination function and a bill counting function. A reverse-presented bill inverting section 37 is disposed below the discrimination section 36, and a temporary stacking section 38 is disposed in front of the discrimination section 36.

Bill convey paths R1, R2, R3, R4, R5, R6 and R7 are formed in main body 11*a* to convey bills A to the corresponding sections. Each convey path R1, R2, R3, R4, R5, R6, R7 is composed of a plurality of rollers including a driving roller, and a plurality of convertor belts extended along the plurality of rollers.

First to eighth selector gates 39*a*, 39*b*, 39*c*, 39*d*, 39*e*, 39*f*, 39*g* and 39*h* are disposed at the first to eighth branches of the convey paths, respectively. Selector gates 39*a* to 39*h* are respectively driven by rotary solenoids (not shown) to guide the bill A to one of the two different convey paths when the bill A has reached at the corresponding branch. Bill flow sensors 40*a* to 40*u* are arranged at respective prescribed positions of the first to seventh convey paths R1 to R7. Bill presence/absence sensors (residual bill sensors) 41*a* to 41*i* are disposed at respective stacking locations of the bills A. Each of sensors 40*a* to 40*u* and 41*a* to 41*i* includes a pair of well known light-emitting and light receiving elements.

A full-state sensor 42, a pre-full-state sensor 43, and an empty-state sensor 44 (or a pre-empty-state sensor) respectively composed of a microswitch are arranged in each of bill storage sections 16, 17, 18 and 19.

A rejected bill stacking section 49 is disposed under first storage section 16.

The operation of bill conveying section 9 will now be described. When a withdrawal button (not shown) in input section 1 shown in FIG. 1 is operated, an instruction indicated on display section 3 is changed to indicate prescribed successive processes of the withdrawal operation. Based on the instructions displayed, an operator inputs a password, an amount of bill requested and data of denomination, and then operates a confirmation button (not shown). Thus, control unit 5*a* of control section 5 outputs a bill dispensing command to bill receiving/dispensing mechanism 12. According to the requested amount of bill and data of denomination, bills stacked in second and third cassettes 21 and 22 are taken out one by one to convey path R5 by second and third bill stacking/dispensing units 25 and 26. Number of bills taken out from second and third cassettes 21 and 22 are respectively counted by bill flow sensors 40*q* and 40*r*. Then, bills A are sequentially gated through selector gates 39*d* and 39*e* respectively, and are sent to discrimination section 36 through convey path R4. Bills A are discriminated by discrimination section 36. If a bill is improper to be dispensed in discrimination section 36, the improper bill is gated by selector gate 39*a* and is fed to first bill stacking /dispensing unit 24 to be stacked in either bill cassette 20 or rejected bill stacking section 49. At the same time, bill A is subject to denomination / discrimination in discrimination section 36 so that bill A is rechecked as a bill dispensed from the corresponding one of bill cassettes 21 and 22. This denomination/discrimination normally need not be executed. However, the possibility exists that bank personnel may erroneously replenish the bills when he or she supplies the bills into the corresponding bill cassettes. To avoid the problem caused by the erroneous replenishment, this denomination / discrimination is preferred. After the above-described discrimination operation is performed, bills A are fed to temporary stacking section 38 through convey path R3.

Upon stacking bills A corresponding to the required amount and the designated denomination by the operator in temporary stacking section 38, bills A are further fed by the operation of a feeding mechanism (not shown) from temporary stacking section 38 to bill receiving/dispensing section 15. Then, lid 7*a* of bill part 7 opens, end the bills A stacked in bill receiving/dispensing section 15 are moved upwardly by a dispensing mechanism (not shown) of bill receiving/dispensing section 15 such that the edges of bills project from bill port 7. The bill dispensing operation is finally ended when the operator takes out bills A from bill port 7.

Figure 4:
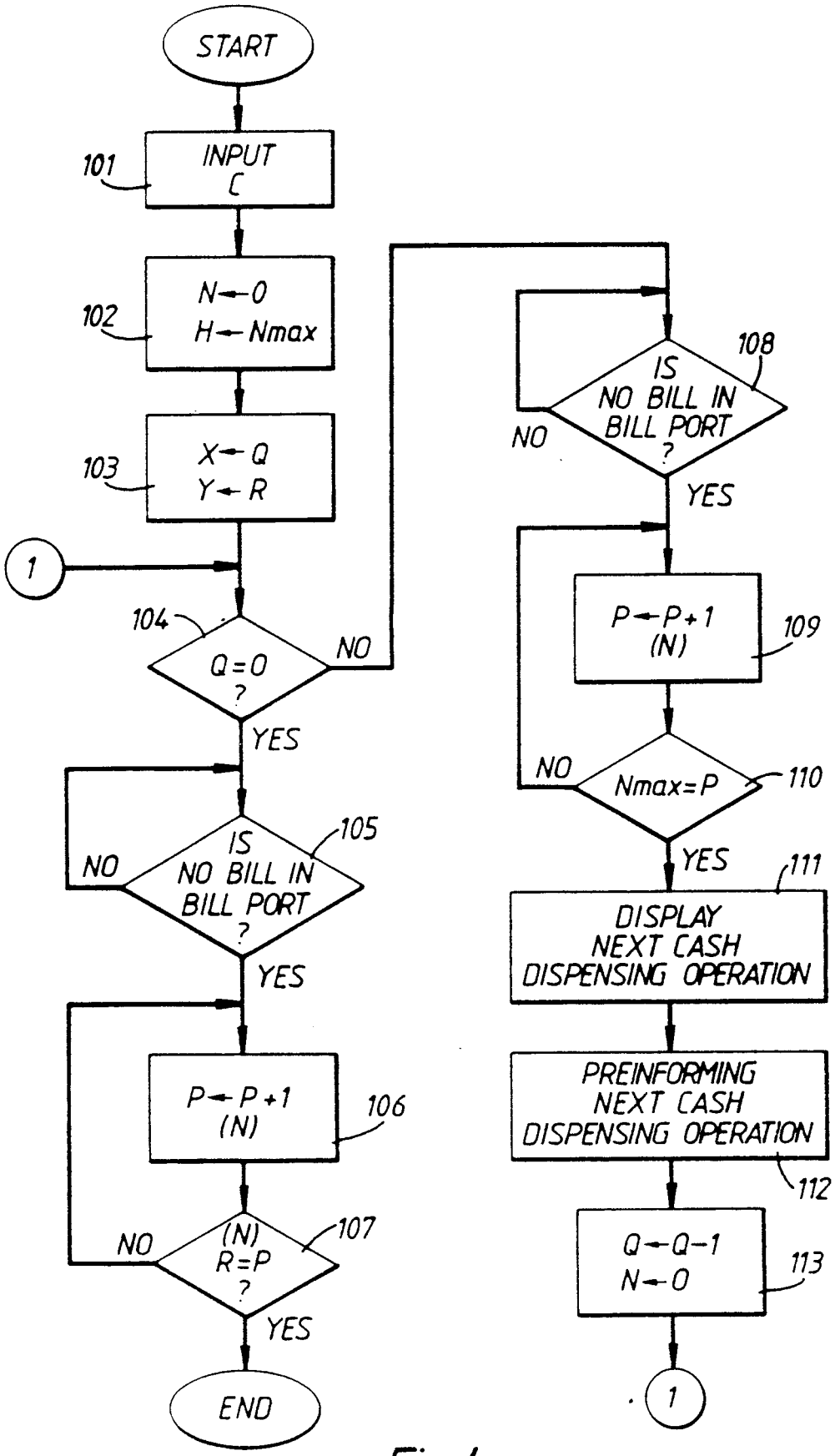
FIG. 4 is a flow chart explaining the operation of the apparatus.

The operation of the one embodiment of the present invention will now be described with reference to FIG. 4. When control unit 5*a* receives the number of bills C requested by an operator through input section 1 (step 101), control unit 5*a* clears register N storing the number of bills picked out from bill cassettes 21 and 22, and sets a prescribed maximum number of bill Nmax, e.g., 100, to a register H (step 102). Register H indicates a maxrmum number of bills which can be dispensed to bill receiving/dispensing section 15 at one time. The number of requested bills C is divided by the prescribed maximum number of bill Nmax, and then, the quotient Q and the residual R are stored in the corresponding registers X and Y, respectively (step 103). According to this division, it is determined that the requested amount of bills C can be dispensed by one dispensing operation if the quotient Q is zero. Otherwise, more than one dispensing operation are needed to dispense the requested amount of bills C. The number of the dispensing operations can be determined by adding one to the value of the quotient Q. In step 104, the value Q of register X, i.e., quotient Q, is discriminated. If the value Q of register X is zero, the YES-path is taken. Otherwise, the NO-path is taken. If the YES-path is taken in step 104, Control unit 5*a* checks the presence of bills in bill port 7 by residual bill sensors 41*a* and 41*b* (step 105). If the presence of bills is detected by sensors 41*c* and 41*b*, the NO-path is taken and step 105 is reexecuted until the absence of bill is detected. Otherwise, the YES path is taken in step 105. In step 106, bills stored in bill cassettes 21 and 22 are respectively taken out one by one, as stated above, and the value P of register N is renewed by adding one to value P. This operation is carried out repeatedly until the value P of register N coincides with the value R of register Y. When the value P of register N coincides with the value R of register Y, lid 7*a* of bill port 7 opens to dispense the bills A stacked in bill receiving/dispensing section 15.

If the NO-path is taken in step 104, control unit 5*a* checks the presence of bills in bill receiving/dispensing section 15, and the NO-path is taken if the presence of bills is detected. This checking operation is repeatedly executed until the absence of bills detected. If the YES path is taken in step 108, bills stored in bill cassettes 21 and 22 are respectively taken out one by one, and the value P of register N is renewed by adding on to value P in step 109. This operation is carried out until the value P of register N reaches the value Nmax of register H (step 110). When the value P of register N coincides with the value Nmax of register H, the above-described bill dispensing operation is carried out. At this time, display section 3 indicates the existence of successive bill dispensing operations (step 111). In step 112, preinforming section 13 generates a synthetic sound to draw the operator's attention simultaneously. Thus, a situation in which the operator misunderstands the completion of the bill dispensing operation and bills dispensed by the next bill dispensing operation have been left in bill receiving/dispensing section 15 can be avoided.

In step 113, control unit 5*a* decrements the value Q of register X by one, and clears the value P of register N. Then, the above-described step 104 is reexecuted. Since the value Q of register X is decremented, it is determined whether or not the number of the remaining bills to be dispensed is less than the maximum number of bills Nmax in step 104. If the number of the remaining bills to be dispensed is less than the maximum number of bills Nmax, the YES-path is taken, and the above-described steps 105, 106 and 107 are executed. Otherwise, the NO-path is taken, and the above-described steps 108, 109, 110, 111, 112 and 113 are repeatedly executed until the value Q of register 104 reaches zero. For example, if the number of bills to be dispensed is 106, the value Q of register X, i.e., quotient Q, is one and the value R of register Y, i.e,. residual R, is six when step 103 is executed. In step 104, the NO-path is taken end steps 108, 109 110, 111, 112 and 113 are executed to dispense the maximum amount of the bills Nmax, i.e., 100. When step 104 is reexecuted, the YES-path is taken, and steps 105, 106 and 107 are executed to dispense the remaining number of the bills, i.e., 6.

With the above-described embodiment, the requested amount of bills can be withdrawn by one input operation even if the requested amount of bills are more than the maximum number of bills Nmax which is dispensed to bill port 7 by one bill dispensing operation. The input operation need not be performed several times. Furthermore, since display section 3 indicates the existence of successive bill dispensing operations and preinforming section 13 generates a synthetic sound to draw the operator's attention simultaneously when the bill dispensing operation is further performed, a situation in which the operator misunderstands the completion of the bill dispensing operation can be avoided.

The above-described presently preferred embodiment is directed to a machine that dispenses bills (paper money). However, the invention could also be applied to a coin dispensing machine or some other type of machine. Furthermore, the invention is applied to a cash receiving/dispensing apparatus used for the cash management in a bank. However, the invention may be applied to an automatic teller machine (ATM) or an automatic dispensing apparatus (CD).

The present invention has been described with respect to a specific embodiment. However, other embodiment based on the principles of the present invention will be obvious to those of ordinary skill in the art. Such embodiments are intended to be covered by the claims.

What is claimed is:

1. An automatic cash transaction apparatus, comprising:

input means for inputting by a user a requested amount of cash;

cash dispensing means for dispensing up to a predetermined maximum amount of cash during a single dispensing operation thereof;

means for determining whether a requested amount of cash will require more than one dispensing operation;

means, responsive to the determining means, for causing the cash dispensing means to a) perform a single cash dispensing operation when the requested amount of cash does not exceed the maximum amount, and a) perform successive cash dispensing operations when the requested amount of cash exceeds the maximum amount; and preinforming means for informing a user that a successive cash dispensing operation will occur when a current cash dispensing operation is completed if a successive cash dispensing operation will take place.

2. An apparatus according to claim 1 further including means for displaying information regarding the carrying out of the next cash dispensing operation when a current cash dispensing operation is completed if the successive cash dispensing operations are carried out.

3. An apparatus according to claim 1, wherein the preinforming means includes means for generating an audible sound to draw an operator's attention.

4. An automatic cash transaction apparatus, comprising:

a main body including a plurality of cash cassettes in which an amount of cash is stacked;

input means, arranged in the main body, for inputting by a user a desired amount of cash;

cash dispensing means, provided in the main body, for dispensing up to a predetermined maximum amount of cash during a single dispensing operation thereof;

control means for determining whether a requested amount of cash will require more than one dispensing operation and for causing the cash dispensing mean to a) perform a single cash dispensing operation when the requested amount of cash does not exceed the maximum amount, and a) perform successive cash dispensing operations when the requested amount of cash exceeds the maximum amount; and preinforming means for informing a user that a successive cash dispensing operation will occur when a current cash dispensing operation is completed if a successive cash dispensing operation will take place.

5. An apparatus according to claim 4 further including means, provided in the main body, for displaying information regarding the carrying out of the next cash dispensing operation when a current cash dispensing operation is completed if the successive cash dispensing operations are carried out.

6. An apparatus according to claim 5, wherein the main body has a bill port covered with a slidable lid, and the cash dispensing means includes cash conveying means for conveying cash from one of the plurality of cash cassettes to the bill port, the lid opening when cash is conveyed to the bill port.

7. An apparatus according to claim 6, wherein the control means includes means for operating the preinforming means when the cash is taken out from the bill port.

8. An apparatus according to claim 6, wherein the control means includes means for operating the preinforming means when the lid opens.

9. An apparatus according to claim 5, wherein the control means includes means for operating the preinforming means when the display means indicates the execution of the next dispensing operation.

10. A method for cash dispensing using an automatic cash transaction apparatus, comprising the steps of:

inputting by a user a requested amount of cash;

determining whether a requested amount of cash exceeds a predetermined amount of cash that can be dispensed during a single dispensing operation of a cash dispensing means;

causing the cash dispensing means to a) perform a single cash dispensing operation when the requested amount of cash not exceed the maximum amount, and a) perform successive cash dispensing operations when the requested amount of cash does exceeds the maximum amount; and informing a user that a successive cash dispensing operation will occur when a current cash dispensing operation is completed if a successive cash dispensing operation will take place.

11. A method according to claim 10 wherein said informing step comprises the step of generating an audible signal.

12. A method according to claim 10 further comprising the step of displaying visible information to the user regarding cash dispensing operations.

* * * * *